US006276722B1

(12) United States Patent
Moor

(10) Patent No.: US 6,276,722 B1
(45) Date of Patent: Aug. 21, 2001

(54) BINDER WITH EXPANDABLE COVERS

(75) Inventor: Marc L. Moor, Oakwood, OH (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/538,390

(22) Filed: Mar. 29, 2000

Related U.S. Application Data

(60) Provisional application No. 09/065,996, filed on Apr. 24, 1998, now Pat. No. 6,059,478.

(51) Int. Cl.[7] ..... B42D 3/00

(52) U.S. Cl. ..... 281/29; 281/37; 402/70; 402/73

(58) Field of Search ..... 281/29, 31, 37, 281/36, 45; 402/70, 73; 206/472, 424; D19/27

(56) References Cited

U.S. PATENT DOCUMENTS 6,045,161 * 4/2000 Ashcraft et al. ..... 281/37
6,059,478 * 5/2000 Moor ..... 402/73
6,086,106 * 7/2000 Joe et al. ..... 281/37 X

* cited by examiner

*Primary Examiner*—Willmon Fridie, Jr.

(74) *Attorney, Agent, or Firm*—Thompson Hine LLP

(57) ABSTRACT

The invention provides a binder or portfolio for carrying looseleaf paper, books, school supplies, etc. wherein said binder includes an expandable gusset attached to the front and back covers of the binder. The covers of the binder are foldably attached to a central spine and the gusset is split into two sections running along the periphery of the inner sides of the covers. The gusset is provided with a means for releasable attachment such that when the front cover of the binder is folded over the back cover of the binder, the two sections of the gusset may be attached to one another, thereby securing the contents of the binder inside. Preferably, the gusset is made from an elastic material such as neoprene and the releasable means of attachment is a zipper-type closure. This construction of the gusset from an expandable material allows oversized objects such as larger textbooks to be placed in the binder without damaging the structural integrity of the gusset and the binder when the binder is fastened shut. An embodiment is disclosed wherein the covers are provided with a window also substantially formed from an elastic material, further increasing the expandability of the binder. Means for securing such a gusset to a binder are also provided, specifically a means for biasing the gusset outward of the binder so that the gusset does not interfere with the insertion of items into the binder. This outward biasing of the gusset also facilitates the securing of the two portions of the gusset by the releasable closure means.

16 Claims, 6 Drawing Sheets

BINDER WITH EXPANDABLE COVERS

CROSS-REFERENCE TO RELATED APPLICATION

This application claims priority from application Ser. No. 09/065,996 entitled Binder with Elastic Gusset, filed Apr. 24, 1998. U.S. Pat. No. 6,059,478.

BACKGROUND OF THE INVENTION

This invention relates to a portfolio or binder for holding papers, books, school supplies, etc., which includes a gusset made of neoprene or a similar elastic material disposed substantially between the front and back covers of the binder. The gusset is capable of expanding to accommodate any large or oversized items that may be placed within the binder. More particularly, the present invention relates to a binder wherein an expandable gusset is incorporated between the front and back covers of the binder, the gusset has a front portion and a back portion corresponding to the front and back covers of the binder, and the gusset includes a closure means which releasably fastens the two portions of the gusset together, thereby enclosing the contents of the binder.

In the past there have been binders and portfolios having zippered closures for retaining loose items in the binder. An example of this type of binder is disclosed in U.S. Pat. No. 2,778,397 which illustrates a cover for a loose leaf notebook or the like. The cover is composed of a unitary piece of leather and is closed by means of a zipper U.S. Pat. No. 2,755,837 discloses a brief case for holding personal papers having a back portion with a pair of side panels that are connected by a slide fastener. Yet another example is shown in U.S. Pat. No. 2,173,120 which discloses a brief case having front and rear flexible panels, preferably made of leather, that are spaced apart by a split flexible gusset having a zipper mechanism for closing the gusset. A strengthening member is employed to help the flexible components and gusset to retain their desired shape.

While many of these prior art binders have advantages, there continues to be a need to design binders having which are flexible, durable, sturdy, and inexpensive to manufacture. Furthermore, it would be desirable to have a binder that is capable of holding a large amount of material, to the point of being filled to greater than normal capacity, without endangering the structural integrity of the binder. It is further desired to have a binder which includes a gusset that stands generally upright when the binder is fully opened thus allowing easy access to the contents of the binder.

SUMMARY OF THE INVENTION

In accordance with the present invention, a binder or portfolio is provided which has an expandable gusset made of an elastomeric material. More particularly, the invention provides a binder or portfolio comprising a front and back cover foldably joined to a central spine having an expandable gusset substantially formed from a flexible, elastic material. The gusset has a front portion attached to the periphery of the underside of the front cover, and a back portion attached to the periphery of the underside of the back cover, wherein the two portions of the gusset may be releasably fastened to one another when the front cover is folded over on the back cover.

The binder of the present invention is equipped with a ring type closure for securing loose leaf papers. However, in the portfolio the ring closure is omitted so that the covers enclose a generally open area for the carrying of loose objects and papers. While the discussion which follows references the embodiment of the invention which is a binder, those skilled in the art will recognize that the discussion applies equally to portfolios. In a preferred embodiment, the covers of the binder include a cushioning member made of a suitable material, such as high density pearlized foam, attached to a rigid polyethylene board which is covered in a durable fabric, such as nylon. Preferably, the front and back portions of the gusset are incorporated into the binder in a way so as to allow the gusset to stand up when the binder is fully opened thereby providing unfettered access to the contents. While it is contemplated that many different closure means may be used to secure the front and back portions of the gusset together when the binder or portfolio is folded to a closed position, in a preferred embodiment a zipper type closure is employed. This zipper closure can be one of any number of different configurations, including closed-end type, open-end type, or a combination of the two.

In a further embodiment of the invention, the elastic material is also incorporated into a window in the front and/or back cover of the binder to provide still additional expansion capability. Also within the scope of the invention is an embodiment wherein the front and back covers are covered almost entirely from the elastic material. One of ordinary skill would recognize that this embodiment, while useful in conjunction with the expandable and outwardly-biased gussets described herein, would be useful in binder applications not incorporating expandable or outwardly-biased gussets.

DETAILED DESCRIPTION

Figure 1:
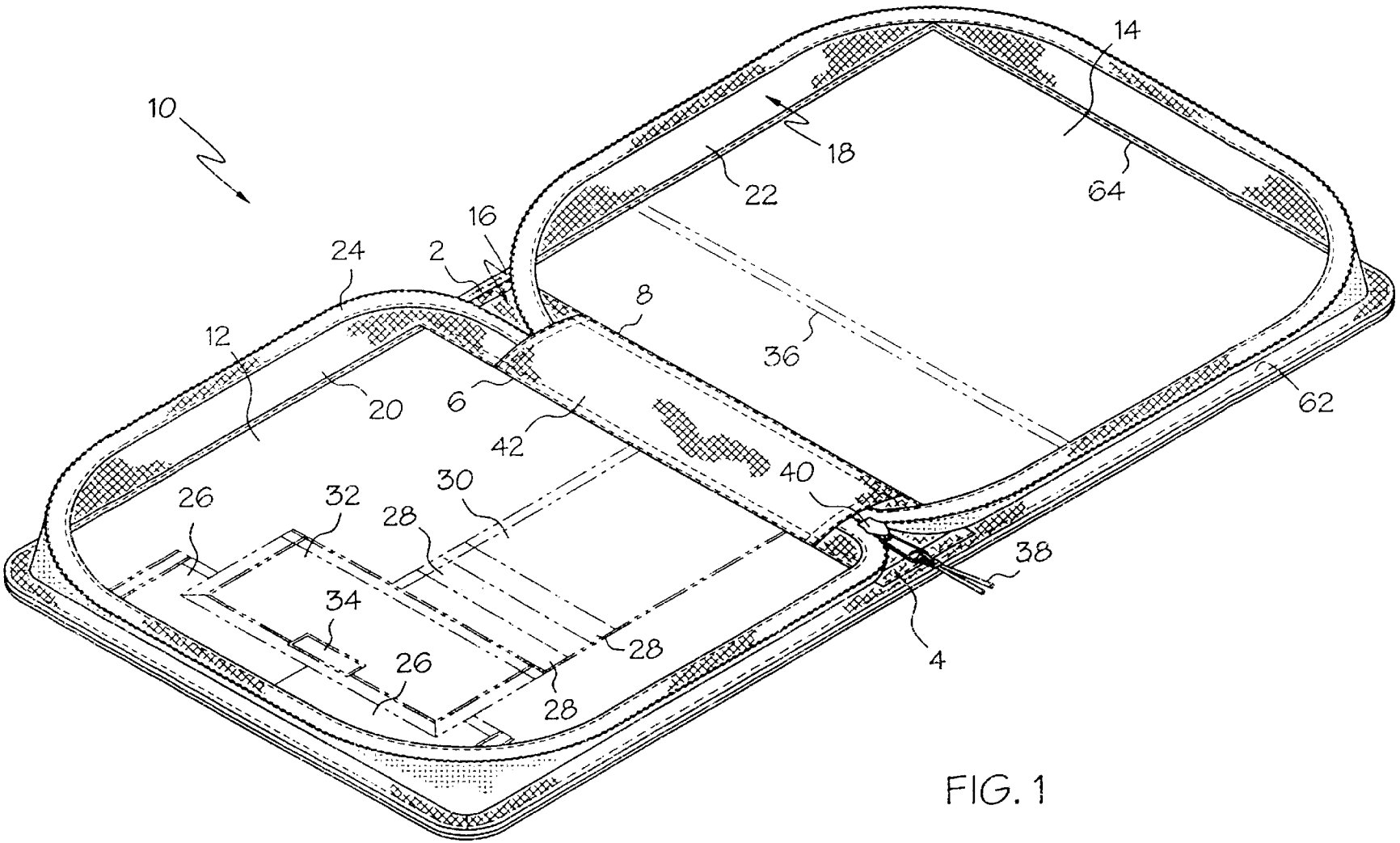
FIG. 1 is a top perspective view of a binder or portfolio with an elastic gusset in accordance with the present invention.
Figure 2:
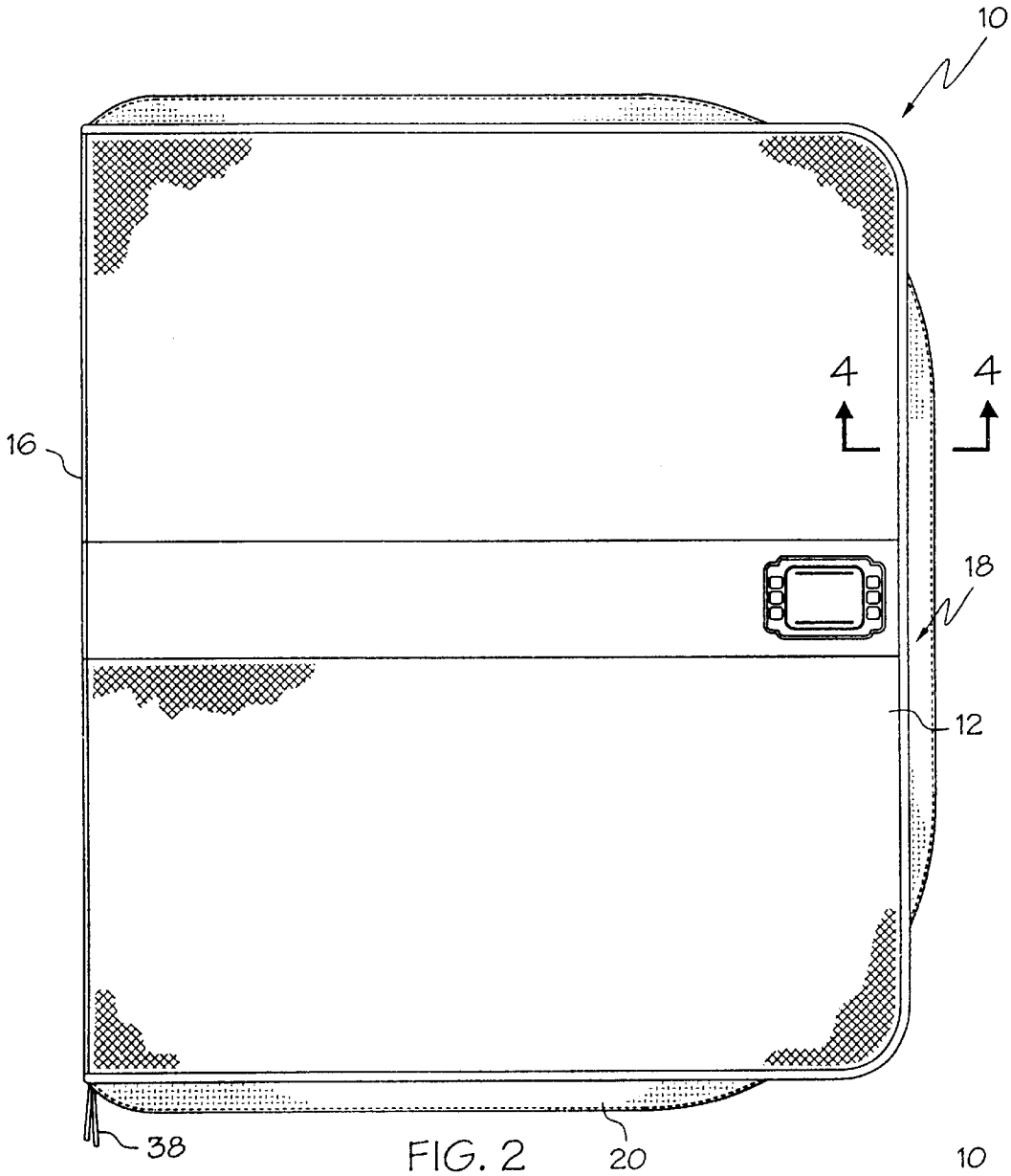
FIG. 2 is a plan view of the top of the closed binder of FIG. 1.
Figure 3:
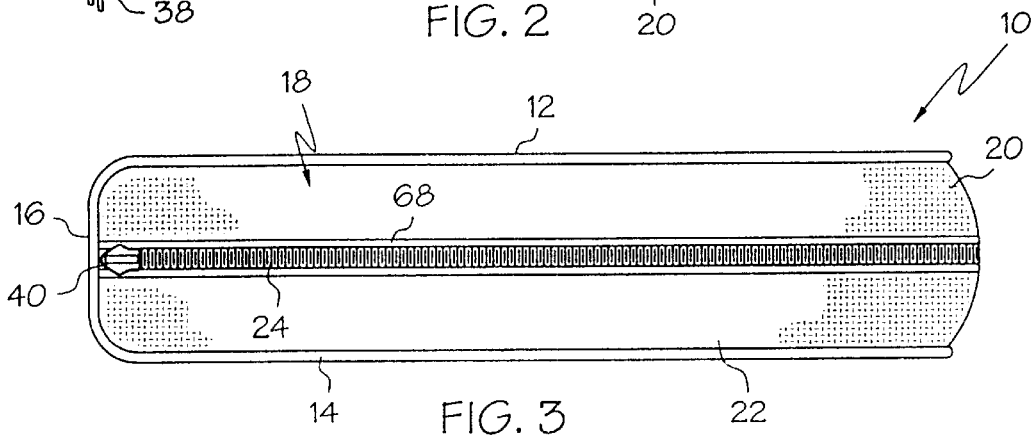
FIG. 3 is a side elevational view of the binder of FIG. 2.

Referring to FIGS. 1, 2 and 3, the binder or portfolio generally designated 10 of the present invention includes a front cover 12, back cover 14, a central spine 16 having a top 2, bottom 4, and two sides 6, 8, and an expandable gusset 18, preferably made of an elastomeric material such as foamed neoprene. The front cover 12 and back cover 14 are spaced apart from each other by the central spine 16 and the expandable gusset 18. The expandable gusset 18, is divided into a front portion 20, corresponding to the front cover 12, and a back portion 22, corresponding to the back cover 14. The two portions of the gusset 18 share a zipper 24, which can be closed to secure the contents of the binder 10.

In a preferred embodiment, the binder 10 has various pockets sewn into the inside of the front cover 12. Illustrative of the variety of pockets that may be utilized, the embodiment as shown in FIG. 1 has computer disc pockets 26, pencil pockets 28, and a miscellaneous pocket 30. Computer discs (not shown) are held into the computer disc pockets 26 by a flap 32 that is secured by a hook and loop closure 34. A pocket 36 which runs the width of the back cover 14 of the binder 10 of the present invention is provided to allow for insertion of a tongue for a ring closure (not shown). Alternatively, the ring closure can be sewn into the spine or secured to the spine using rivets or other fasteners known in the art. While the number and function of the pockets herein described are those of a preferred embodiment, it would be clear to one of ordinary skill that any number of combinations, including elimination of the pockets altogether, may be utilized without departing from the scope of the invention.

As mentioned above, the gusset 18 of the binder 10 includes zipper 24 for securing any loose items within the binder 10. When the front cover 12 and back cover 14 are folded over onto each other, i.e. closed, the binder 10 can be secured by the zipper 24, which operates in a conventional manner. Thus, the binder is secured by grasping the pull tab 38 of the sliding member 40 and moving the sliding member 40 along the outer periphery of the covers until the sliding member 40 abuts a flexible expansion panel 42 fixedly attached to the spine 16 and the covers 12, 14 to prevent the covers from bending backward when the binder 10 is laid open. Thus, in this manner the binder is securely closed. While the embodiment depicted in FIG. 1 shows a binder having a zipper of the closed end-type, it should be clear that an open-end zipper, or a zipper having a straight run along one side of the binder or portfolio, as well as various other zipper arrangements would be suitable. Furthermore, the use of non-zipper closure methods such as hook and loop, snaps, etc., or a so-called zip-lock slide closure would also be considered within the scope of the present invention.

Figure 4:
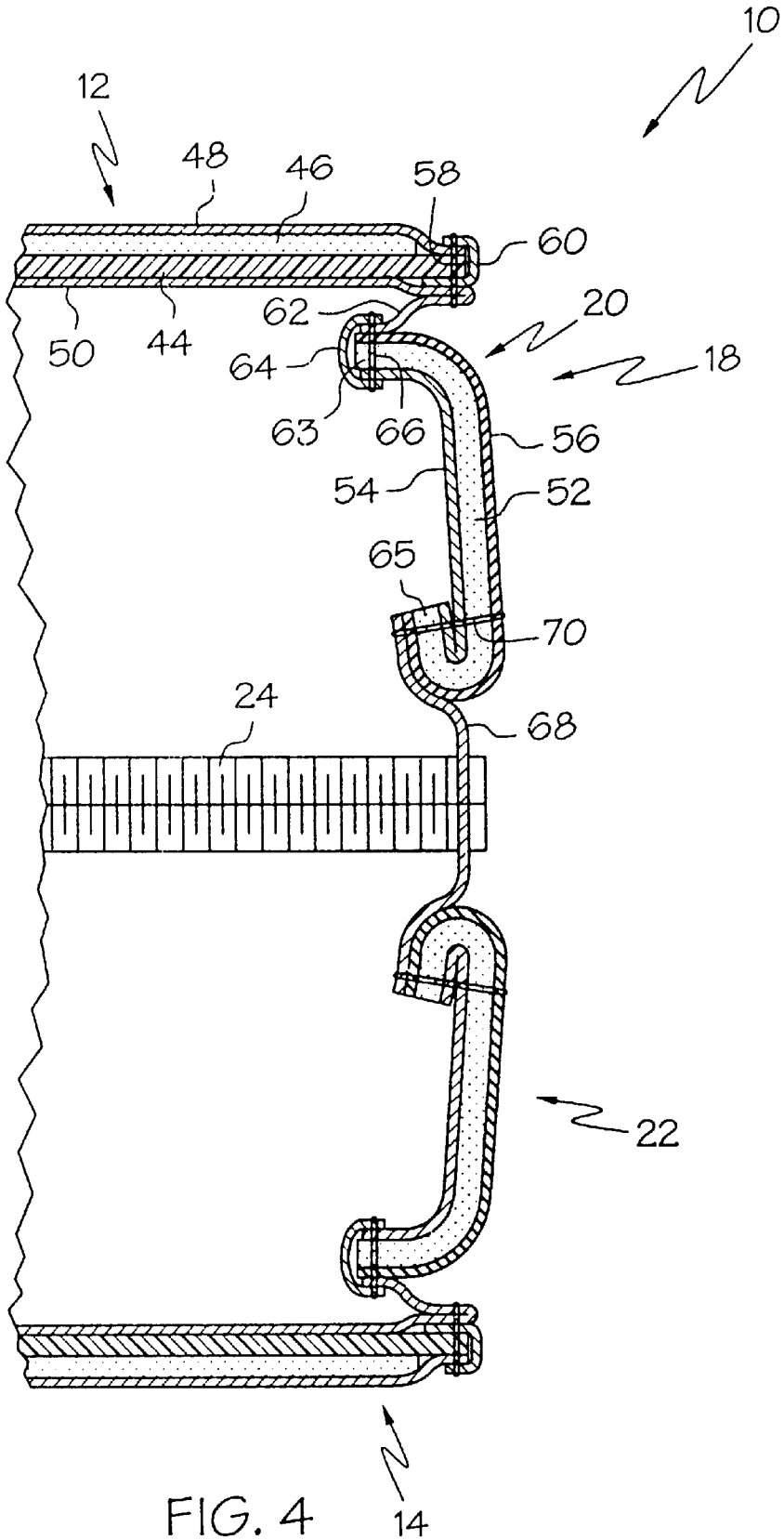
FIG. 4 is a schematic cutaway side elevational view of the binder of FIG. 2 taken at line 4—4.
Figure 5:
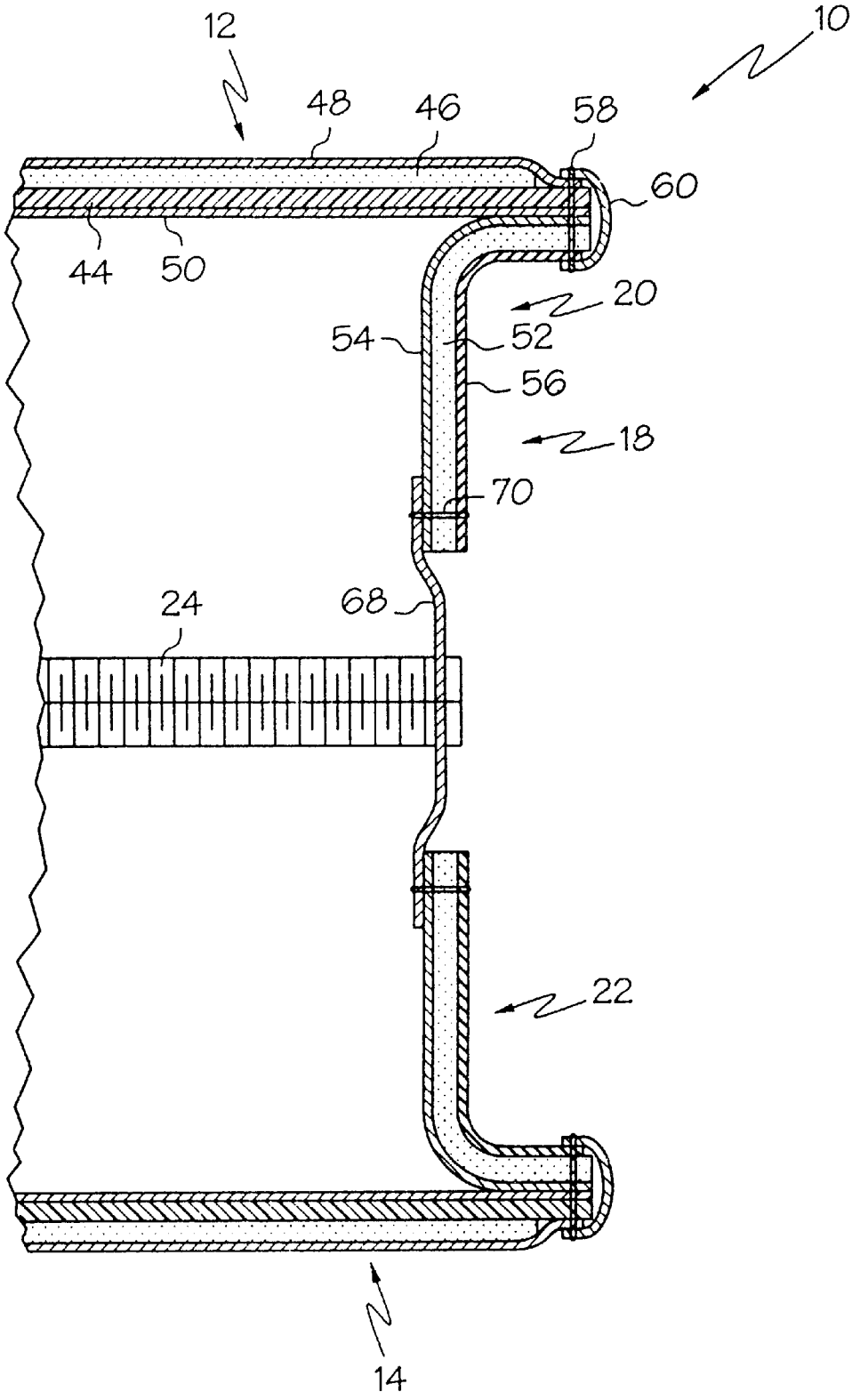
FIG. 5 is a schematic cutaway side elevational view of an alternate embodiment of a binder of in accordance with the present invention.
Figure 6:
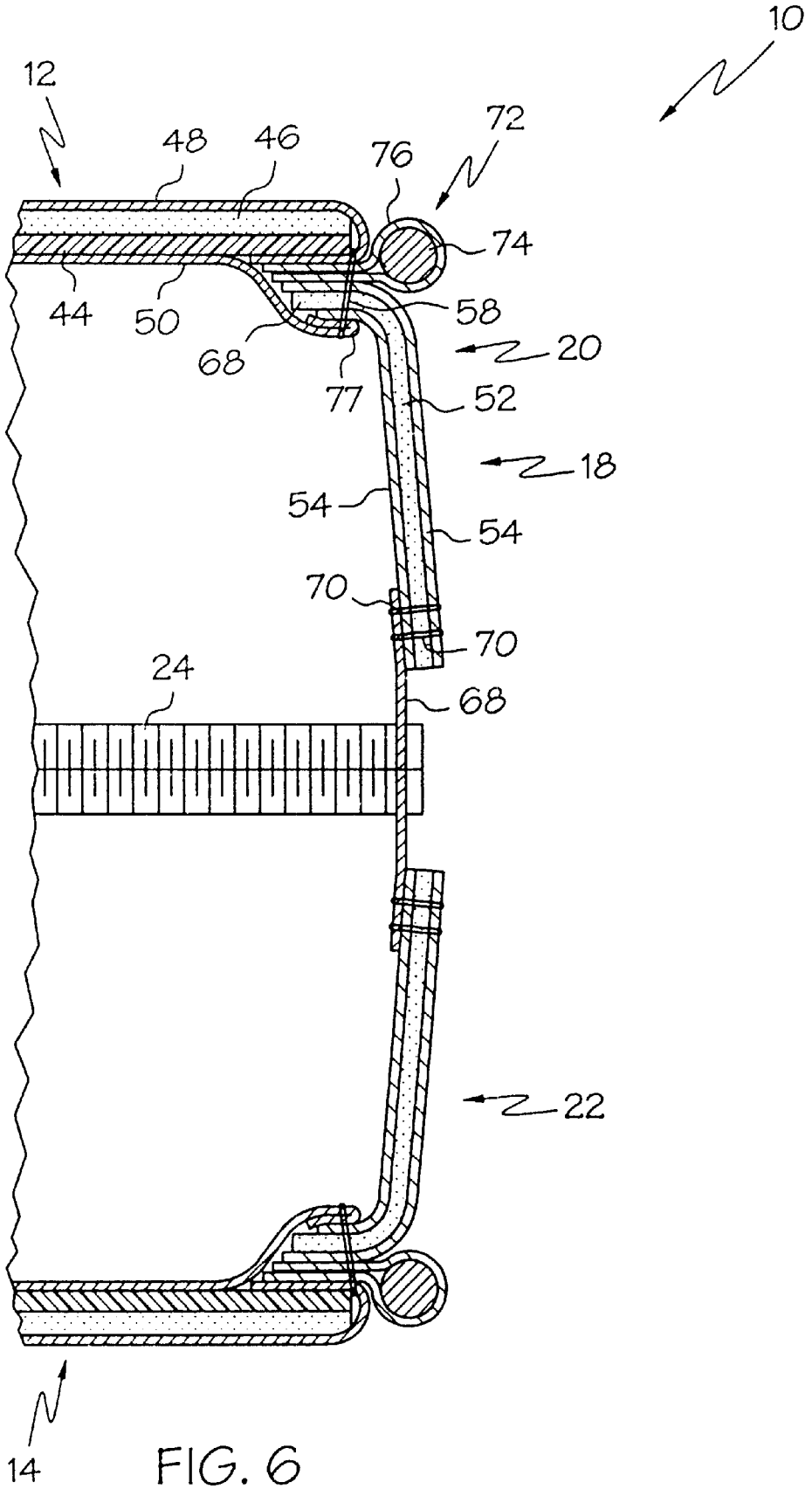
FIG. 6 is a schematic cutaway side elevational view of an alternate embodiment of a binder in accordance with the present invention.

As shown in FIGS. 4, 5, and 6, all of the embodiments illustrated have covers 12, 14 which are structurally defined by a rigid board 44, preferably made of polyethylene. Cushioning liner material 46 is carried on the rigid board 44 and both are then covered in a textile material 48. Although any suitable materials may be employed in these applications, it has been found that highly durable materials such as high density pearlized foam for the cushioning material and nylon fabrics for the textile covers are preferred. The use of the cushioning material 46 with the rigid board 44 and textile outer covering 48 provides surfaces which are padded, yet sturdy and durable. The underside of the covers 12, 14 are covered in a textile inner lining material 50, which may be the same material that is employed for the outside covering. Also, all of the embodiments employ an expandable gusset 18, having a front portion 20 and a back portion 22, which is made of an elastic material 52. The elastic material 52 of the invention is at least partially composed of an elastomer. The term "elastomer" is used in this sense to define a natural or synthetic rubber or plastic, which at room temperature can be extensively stretched under low stress (e.g., to twice its original length) and, upon release, return almost immediately to its approximate original length. While many elastomers could be used to form the gusset 18, foamed neoprene rubber is preferred. Examples of other suitable materials include those materials conventionally sold as rubber sheet and foamed rubber sheet. These materials are desirable because they can expand in two directions.

In a preferred embodiment, the elastic material 52 of the gusset 18 has an expandable fabric facing 54 laminated on at least one side of the gusset 18. The laminate material may be any suitable fabric such as a knit woven from spandex yarns or a nylon material woven with bands of an elastic material, as long as the laminate is capable of expanding with the elastic gusset material. The expandable fabric facing 54 adds strength and durability to the gusset 18, thereby increasing the usable life of the binder 10. It can be laminated on one side of the gusset 18, as shown in the embodiments depicted in FIGS. 4 and 5, or on both sides, as in the embodiment shown in FIG. 6. As in the embodiments shown in FIGS. 4 and 5, if the gusset 18 does not have the flexible fabric facing 54 laminated on both sides of the elastic material 52, the elastic material 52 can be finished with a textured skin 56, thereby increasing the durability and aesthetic appeal of the gusset 18. The textured skin 56 is formed during the manufacture of the elastic material 52 and can be made to resemble a woven material or other design to improve the appearance of the binder.

The construction of the front and back portions of the binder 10 of the present invention are substantially identical, and as such, for the sake of clarity, only the front portion will be referred to during the description that follows. In a preferred embodiment as shown in FIG. 4, the inner lining material 50 extends to the edge of cover 12 where it is folded over upon itself and secured inside the outer periphery of the cover by outer cover seam 58 which also simultaneously attaches a seam binding or edging material 60 along the outside edge of the binder to give the binder a smooth feel and a finished look while protecting the edge of the cover 12. The folded over inner liner material 50 extends into the interior of the binder to create an inwardly protruding attachment panel 62 for the front portion 20 of the elastic gusset 18. One end 63 of the front portion 20 of the elastic gusset 18 is folded or rolled inwardly so that it overlies the inwardly directed attachment panel 62 and this edge is covered in a seam binding 64 and stitched together by sewn seam 66. By constructing the binder 10 in this manner, the gusset 18 is biased outward of the binder 10 when it is laid open flat, as is shown in FIG. 1. This outward biasing of the gusset 18, as opposed to the inward biasing generally seen in prior binders, is advantageous in that the gusset interferes less with access to the contents of the binder. The other end 65 of the upper portion 20 of gusset 18 is folded over on itself and attached to the zipper ribbon 68 by zipper ribbon seam 70, thereby securing the upper portion 20 of the gusset 18 to the zipper 24. While the seams are illustrated herein as being sewn, e.g., as shown by threads 66 and 70, those skilled in the art will appreciate that other seaming techniques may be used including fusing, adhesives, etc.

As shown in FIG. 5 in an alternate embodiment of the present invention, the inner lining material 50 runs to a point in alignment with the edge of the rigid board 44 where it terminates in a raw edge. One end of the front portion 20 of the elastic gusset 18 is positioned contiguous to this same end of the rigid board 44 and lining material 50, and seam binding 60 is wrapped around the edge of the front cover 12 and the upper portion 20 of the elastic gusset 18 and stitched into place by outer cover seam 58. The other end of the front portion 45 of the is gusset 18 is attached to the zipper ribbon 68 by zipper ribbon seam 70.

As shown in FIG. 6, in a further embodiment of the binder of the present invention, piping 72, consisting of piping cord 74 encased by piping facing 76, is added to improve the edge durability and appearance of the covers of the binder. In order to incorporate the piping 72 into the construction of the binder, piping facing 76 is wrapped around piping cord 74, encasing the piping cord while leaving a sufficient amount of excess fabric such that the piping 72 may be stitched into the front cover 12. The textile outer covering 48 extends beyond the end of the rigid board 44 and cushioning liner material 46 and is wrapped around the edge. With the piping 72 positioned outside of the binder, the excess material from the piping facing 76 is placed over the raw edge of the textile outer covering 48 and lined up with one end 63 of the front portion 20 of the gusset 18 in a sandwich configuration, and the turned over edge 77 of the textile inner lining 50 is placed on top. All of these materials are then sewn together by the outer cover seam 58 creating a smooth finished edge.

Figure 7:
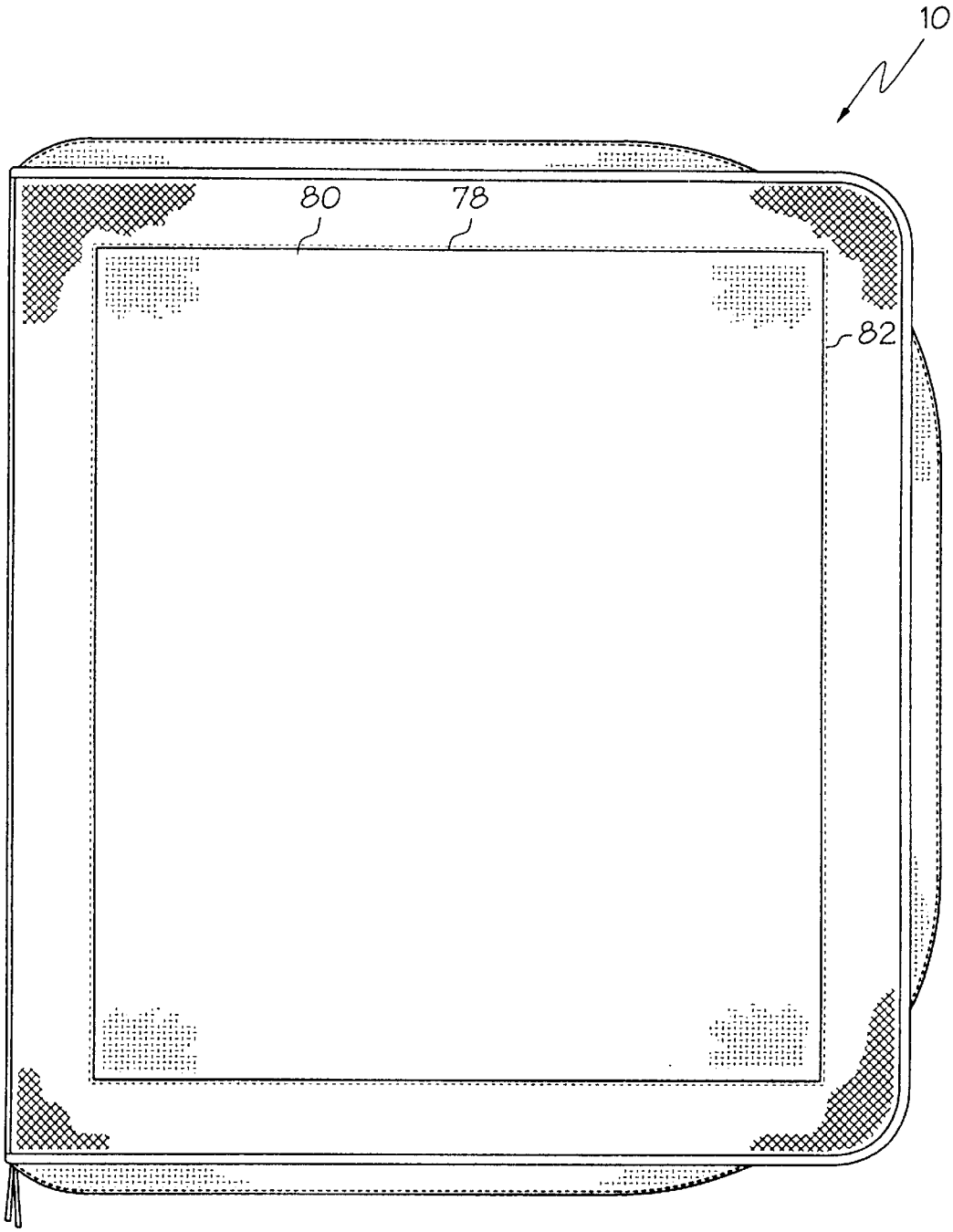
FIG. 7 is a plan view of the top of the closed binder of FIG. 2. having an expandable window feature in accordance with the present invention.

As shown in FIG. 7, in an alternate embodiment of the binder of the present invention, a window 78 is cut out of the front cover 12 of the binder 10. An elastic panel 80 is sewn into the window 78 by panel stitching 82. The elastic panel 80 is preferably made from the same elastic material that is used in the gusset 18. The window 78 and corresponding elastic panel 80 may be of many various shapes and sizes depending on what areas of the binder would benefit from expandable characteristics. While an elastic panel 80 is not shown incorporated in the back cover 14 in FIG. 7, this embodiment is also considered within the scope of the invention. In yet a further embodiment of the invention, the covers 12, 14, are completely covered in the elastic material 52. It is advantageous if the outer face of panel 80 is unfaced foamed neoprene, because the panel 80 provides a frictional surface that prevents books from sliding off the surface of the binder, e.g., as they are carried under the arm.

While the form of the apparatus herein described constitutes a preferred embodiment of the invention, it is to be understood that the invention is not limited to this precise form of apparatus, and that changes may be made therein without departing from the scope of the invention.

What is claimed is:

1. A binder or portfolio comprising:

a front cover having an inner side and an outer side;

a back cover having an inner side and an outer side;

a central spine, said spine including top and bottom ends and two sides, wherein said front cover is foldably joined to one side of said spine and said back cover is foldably joined to the other side of said spine;

wherein a window is cut in at least one of said front and back covers and a panel of elastic material is fixedly attached into said window and comprises the inner and outer side of said cover such that said elastic material may expand outwardly of the binder in response to pressure from objects placed inside said binder.

2. The binder of claim 1 wherein said elastic material is formed from an elastomer.

3. The binder of claim 2 wherein said elastic material is a foamed rubber.

4. The binder of claim 3 wherein said foamed rubber is foamed neoprene faced on at least one side with an elastic fabric.

5. The binder of claim 4 wherein said elastic fabric is spandex.

6. The binder of claim 4 wherein said neoprene is faced on both sides with an elastic fabric.

7. The binder of claim 6 wherein said elastic fabric is spandex.

8. The binder of claim 4 wherein one side of said neoprene is textured.

9. A binder or portfolio comprising:

a front cover frame;

a back cover frame;

a central spine, said spine including top and bottom ends and two sides, wherein said front cover frame is foldably joined to one side of said spine and said back cover frame is foldably joined to the other side of said spine;

wherein said front and back cover frames form windows in said cover frames and are substantially covered in an elastic material fixedly attached in said windows of said cover frames and comprise inner and outer sides of said cover frames such that said elastic material may expand outwardly of said binder in response to pressure from objects placed inside said binder.

10. The binder of claim 9 wherein said elastic material is formed from an elastomer.

11. The binder of claim 10 wherein said elastic material is a foamed rubber.

12. The binder of claim 11 wherein said foamed rubber is foamed neoprene faced on at least one side with an elastic fabric.

13. The binder of claim 12 wherein said elastic fabric is spandex.

14. The binder of claim 13 wherein said neoprene is faced on both sides with an elastic fabric.

15. The binder of claim 14 wherein said elastic fabric is spandex.

16. The binder of claim 12 wherein one side of said neoprene is textured.

* * * * *